US006093002A

United States Patent [19]

Schneider

[11] Patent Number: 6,093,002

[45] Date of Patent: Jul. 25, 2000

[54] TRANSPORT HOSE WITH SAFETY CHANNEL AND METHOD OF USING THE HOSE IN A PUMP

[75] Inventor: Norbert Schneider, Düsseldorf, Germany

[73] Assignee: Alfa Laval Flow GmbH, Dusseldorf, Germany

[21] Appl. No.: 09/234,526

[22] Filed: Jan. 21, 1999

[30] Foreign Application Priority Data

Apr. 2, 1998 [DE] Germany ..... 198 14 728

[51] Int. Cl.[7] ..... F04B 43/08

[52] U.S. Cl. ..... 417/477.12; 417/477.3

[58] Field of Search ..... 417/477.12, 477.13, 417/477.14, 9, 63, 474, 475, 476, 477.15; 604/153; 128/DIG. 12

[56] References Cited

U.S. PATENT DOCUMENTS

| | | | |
|---|---|---|---|
| 3,887,306 | 6/1975 | Gerritsen | 417/477.12 |
| 4,540,350 | 9/1985 | Streicher | 417/475 |
| 4,576,556 | 3/1986 | Thompson | 417/477.12 |
| 4,585,399 | 4/1986 | Baier | 417/477.12 |
| 5,049,048 | 9/1991 | Streicher | 417/477.12 |

FOREIGN PATENT DOCUMENTS

| | | |
|---|---|---|
| 11 82 419 | 11/1964 | Germany . |
| 31 47 790 | 6/1983 | Germany . |
| 33 20 091 | 12/1984 | Germany . |
| 38 27 405 | 2/1990 | Germany . |

*Primary Examiner*—Teresa Walberg
*Assistant Examiner*—Jeffrey Pwu
*Attorney, Agent, or Firm*—Milton Oliver; Ware, Fressola, Van Der Sluys & Adolphson LLP

[57] ABSTRACT

A hose has an internal longitudinal channel in its sidewall as a safety device, to provide a prompt indication of impending failure or leakage into or out of the hose. A hose pump featuring such a hose is an improvement over conventional peristaltic pumps. A squeezing member constricts the hose to move a conveyed product along the hose, thereby causing wear on the hose. Such wear usually manifests itself first as a leak through an inner liner of the hose into the channel. The entrance of conveyed product into the channel, which can be detected by a change in pressure or electrical conductivity, is used as an indicator for wearing out of the hose. The use of such a hose minimizes release of hazardous conveyed materials from the hose into the environment or contamination of conveyed sensitive materials such as foodstuffs by the surrounding environment.

15 Claims, 2 Drawing Sheets

TRANSPORT HOSE WITH SAFETY CHANNEL AND METHOD OF USING THE HOSE IN A PUMP

Cross-reference to related patent, assigned to the assignee of the present invention, the disclosure of which is incorporated by reference: U.S. Pat. No. 5,049,048, STREICHER.

FIELD OF THE INVENTION

The present invention relates to the use of a hose with an outer cover layer, an inner liner, and a reinforcing layer between the cover layer and the inner liner, as well as to a hose pump with a movable squeezing member which squeezes material along the hose but does not thereby occlude a longitudinal safety channel formed within a sidewall of the hose.

BACKGROUND

EP 0 394 383 B1 and corresponding U.S. Pat. No. 5,049,048 disclose a hose with a cover, a liner, and an intermediate reinforcement of wire, fiber, or textile, with a channel running longitudinally through the liner. There, such a hose is proposed as a conveying hose for hose pumps. Such a pump typically has a rotor with several squeezing members which successively squeeze the hose. The channel should be connected at one end with the pump interior and be open to the atmosphere, via a non-return valve, at another end. During operation of the hose pump, the channel, like the conveying hose itself, should be clamped shut by a squeezing member and, in this manner, air is to be removed from the pump housing. In case of damage to the inner wall of the hose, conveyed product is to be released to the atmosphere and observed there.

In practice, it has been found that the desired pumping action of this channel is insufficient. A sufficient pumping action is only achieved if the channel lies outside the textile reinforcement. However, in this case, the desired warning signal of a hose break is first obtained when not only the liner, but also the textile reinforcement, have been damaged.

Transport hoses for sensitive or dangerous media are placed in service without special safety measures, particularly without indicators for hose wearout due to abrasion. The use of the conventional pumping hose as a transport hose for abrasive, dangerous or sensitive conveyable products outside a hose pump housing is not known.

SUMMARY OF THE INVENTION

It is therefore an object of the present invention to provide a transport hose for such media with safety apparatus for early recognition of wearout. This object is achieved by forming a hose with a longitudinal safety channel which does not collapse when the hose is constricted, and detecting if the transported medium invades the safety channel, for example by detecting a change in pressure or conductivity within the safety channel.

It is a further object of the present invention to so improve a hose pump, that a hose break becomes recognizable as soon as possible. In this way, flowable materials which are environmentally sensitive, either because they are hazardous to the surrounding environment or because the surrounding environment is hazardous or contaminating to them, can be more safely transported.

Since, according to the new method of use, damage to the hose liner leads to an opening of the channel to the pump interior, and further since a pressure difference to the end of channel is built up, beginning at the damaged spot, which is subjected to the pressure of the conveyed medium, upon damage to the hose liner, the conveyed medium is forced into the channel and within the channel to its end, and can be reliably detected there. However, in the event of such damage to the hose liner, there is still no danger that the conveyed medium will escape into the environment.

Since in the hose pump, it is provided that the channel is not connected to the pump housing, pumping action through pinching and complete occlusion of the inner cross-section of the channel is not necessary. The form and arrangement of the channel within the liner can thus be substantially freely chosen.

In particular, the channel can be positioned near the open cross-section (lumen) of the hose, so that a hose perforation propagating from the interior of the hose outward can be detected, without the reinforcement having been attacked. Thereby reliably avoided are not only a release of conveyed product into the environment, but also any contamination of the conveyed product by undesired materials. It is advantageous when detection means, for the goods being conveyed, are associated with the channel. So, for example, pressure transducers or conductivity sensors can be provided in the channel itself, in its end regions. For the sake of simplicity, however, the detectors could be located outside the channel in a connection region of the hose termination, the channel there being fed out of the hose via a specially adapted connection.

Since, in a hose pump, the channel is not in communication with the pump housing, there is no danger that the lubricating oil found in the pump housing will come into contact with the conveyed product, in the event that occlusion or damage causes the channel to be opened to the conveyed product. It is thus advantageous if the channel, during operation, always has an open free cross-section in the contact region of the squeezing member. In this case, first of all, the walls of the channel are dynamically loaded only lightly or not at all. Further, for quick recognition of an occlusion, the channel can be continuously flushed or inflated, for example with compressed air.

It is advantageous if the channel connects or communicates, in the region of the pressure or outlet union of the pump, and/or in the region of the intake union, with a conduit equipped with detection means for the presence in the channel of the conveyed product, especially with a pressure sensor or a conductivity sensor. This conduit can be closed with respect to the ambient atmosphere, so that, even in case of damage to the channel, no conveyed product is released into the atmosphere. If the channel connects both in the region of the outlet union and in the region of the intake union with a common conduit, the arrangement of the external sensor and of the channel is symmetrical with respect to the rotation direction of the pump. In the event of a rotation direction reversal, in which the roles of the intake union and the outlet union are reversed, no adaptation measures at the pump are necessary.

A configuration particularly preferred for certain applications results, if the channel presents a lesser wall thickness to the reinforcement than to the inner hose surface. In this configuration, the relatively thick layer of the inner hose surface can serve as an attrition- or utility-layer, which is worn off during operation. Upon reaching of the wearout limit, the channel is opened.

A different preferred embodiment is seen, it the channel presents a greater wall thickness to the reinforcement than to the inner hose surface. This configuration has advantages in case of conveyed products with low abrasive hose wear, since the channel, due to a relatively large spacing from the inner reinforcement, exhibits a high service life or resistance to the squeezing wear-and-tear during the pumping process. Good durability also results, if the hose is so arranged within the pump that the channel is arranged in an area facing away from the squeezing member. There, the dynamic loads due to squeezing are particularly low.

Finally, it can be advantageous, if a plurality of channels are provided in the liner, since then a wearpoint or a beginning hose rupture will be reliably detected, even if the damage occurs in a spatially limited region of the hose wall.

BRIEF FIGURE DESCRIPTION

In the following, exemplary embodiments of the present invention are described, with reference to the drawings. Shown are:

FIG. 1: a conveying hose in a hose pump in the region of contact with the squeezing member;

FIG. 2: a conveying hose like that of FIG. 1 with a different arrangement of the channel; and FIG. 3: a transport hose with a channel located within the liner and an external pressure sensor, in a broken-away view.

DETAILED DESCRIPTION OF THE PREFERRED EMBODIMENTS:

Figure 1:
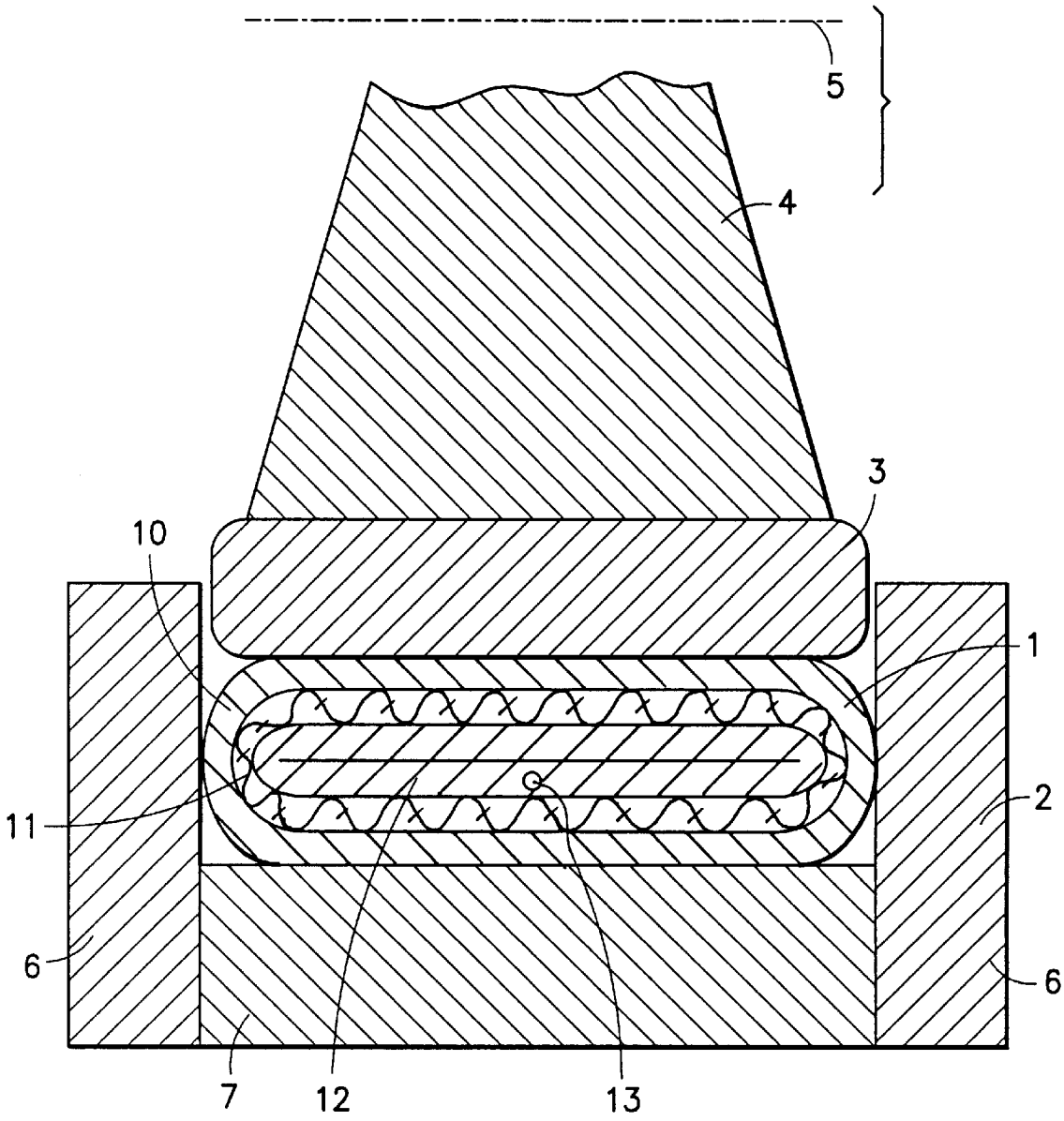

FIG. 1 shows schematically a cross-section through a hose pump with a conveying hose 1, a housing 2 and a squeezing member 3. The squeezing member is part of a rotor 4 which rotates about an axis 5 shown in phantom. Housing 2 includes side covers 6, as well as an outer supporting track or rail 7, on which hose 1 rests. Hose 1 in turn features an outer cover 10 which in the illustrated operating position contacts outwardly supporting track 7, laterally the sidewalls 6, and inwardly (i.e. toward rotation axis 5) the squeezing member 3. Within cover 10, hose 1 includes a high-tensile-strength textile reinforcement 11, on whose inside is joined a liner 12. The inner surface of liner 12 is so pressed together by squeezing member 3 that no free cross-section is left. However, liner 12 incorporates a through-passing channel 13 which is equally spaced from the inner surface of the hose and from the textile reinforcement 11. In the illustrated operating position, in which hose 1 is maximally compressed, channel 13 is not closed or occluded.

Figure 2:
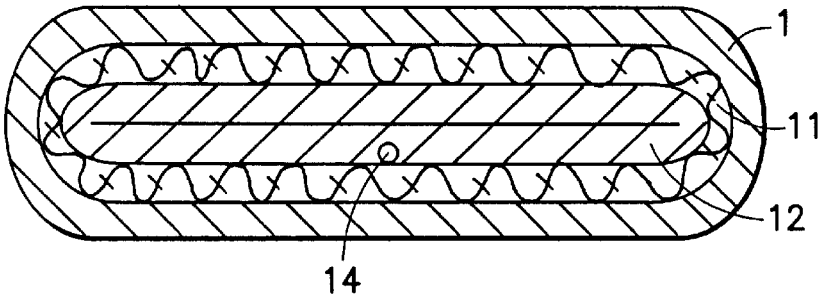

FIG. 2 shows a hose similar to that of FIG. 1 with a different arrangement of the channel. A channel 14 is here arranged so that its free cross-section is immediately adjacent to the textile reinforcement 11, while the thickness of liner 12 between channel 14 and the inner surface of hose 1 is greater than that in the embodiment of FIG. 1.

Figure 3:
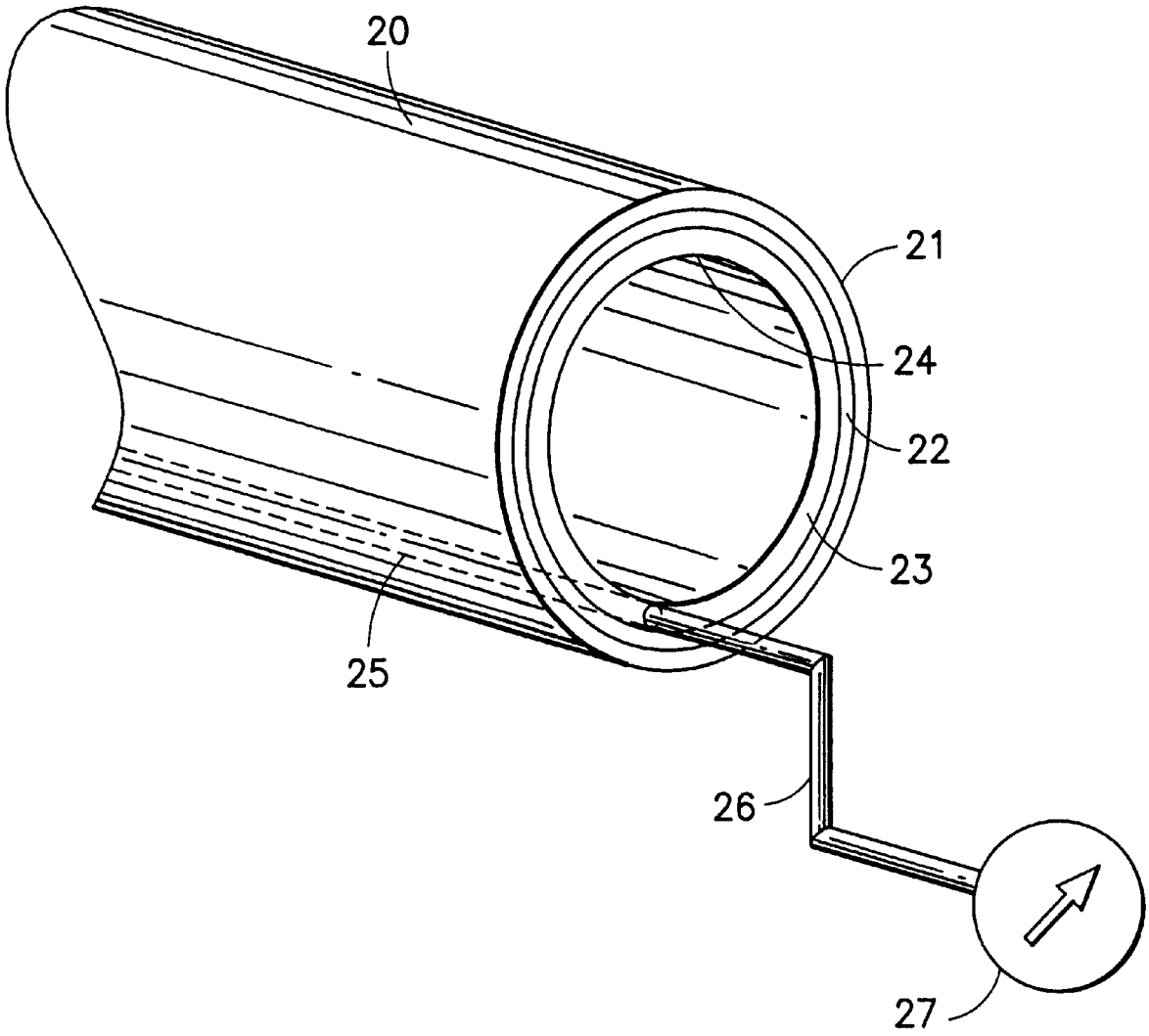

Finally, FIG. 3 illustrates the use of a hose according to FIG. 2 as a transport hose for special conveyable materials. Shown here is a hose 20 having a cover 21, a textile reinforcement 22 and a liner 23. An inner surface 24 of liner 23 defines a lumen which serves as the free transport cross-section of hose 20. A channel 25 is provided in liner 23 parallel to the longitudinal axis of hose 20. Channel 25 extends through the entire length of hose 20, from one hose-end coupling to the opposing hose coupling. The hose couplings are not shown in FIG. 3.

At the front face, i.e. in the region in which a hose coupling is provided, channel 25 feeds into an external sensor conduit 26, which communicates in a pressure-tight manner with channel 25. Sensor conduit 26 in turn communicates with a pressure sensor 27.

In practice, the aforementioned hose pump operates as follows: in a manner known per se, conveying hose 1 is installed in a hose pump and there connects the intake or source union with the outlet or pressure union. Along the part-circular supporting track 7, the hose is continuously in contact with the outer, rotational-axis-coaxial, housing wall. Rotor 4 of the hose pump incorporates, for example, three squeezing members 3, which are arranged symmetrically about rotational axis 5 at 120° intervals. Between each two squeezing members 3, a hose segment is isolated, by the resulting constriction points, from the remaining hose, and, upon turning of rotor 4 in the direction of the outlet union, this isolated hose segment advances. At the constriction point, the conveying hose 1 is clamped from all sides by the squeezing member 3, the sidewalls 6, and the supporting track 7. Liner 23 is so constricted or pinched together, that the open lumen of the conveying hose is completely closed. Since the materials is this region are, like a fluid, incompressible, and since furthermore they are surrounded on all side by the high-tensile-strength web of the textile reinforcement 11, liner 12 cannot be further compressed. Thus, channel 13 is also not closed in the region of a constriction point.

A similar situation applies in case of installation of hose 1 in other hose pumps, for example in those hose pumps having only one squeezing member, or with a squeezing member in the form of an eccentric helix or worm.

In the region of the outlet union and possibly also in the region of the intake union, channel 13 is led out of the housing into an external sensor conduit. This sensor conduit is then provided, in manner known per se, with a conductivity sensor, a pressure sensor, or even with infra-red sensors for hydrocarbons. During normal operation of the pump, no conveyed product is present in channel 13. Channel 13 thus contains essentially air under atmospheric pressure or also a suitable fluid which can react with the conveyed product. If the hose liner is attacked from inside by the conveyed product, by the high pressure or by the constant dynamic stressing, so that rips or abrasions extend to the textile reinforcement, channel 13 is then opened to the inner lumen and thus to the conveyed product. The conveyed product can come into contact with channel 13 and, due to the high pressure (corresponding to the conveying pressure of the pump) can invade channel 13. There, one can either detect a pressure increase, or, in the case of an electrically conductive pumped product, the conductivity can be used as a warning signal. In the embodiment of FIG. 1, channel 12 is spaced from both the inner surface of hose liner 12 and from textile reinforcement 11. The thickness of liner 12, found between the inner surface and channel 13, can thus be regarded as an attrition- or utility-layer of hose 1, upon whose wearing away, a warning signal is generated. Upon reaching channel 13, the conveyed product has not yet come into contact with textile reinforcement 11, and naturally also not yet with the housing interior, so that one need have no fear of a more extensive seal failure or leakage in the web region, of a release of the conveyed product into the atmosphere, or of a contamination of the conveyed product by the lubricating oil present in the pump housing.

In the hose embodiment of FIG. 2, channel 13 is located in the immediate vicinity of textile reinforcement 11. Here, the thickness of the attrition- or utility-layer between the inner surface of liner 12 and channel 14 is greater than in the embodiment according to FIG. 1. In the case of particularly abrasive media, this hose has a longer service life or time-before-failure than that of FIG. 1. In this embodiment, it can be advantageous that channel 14 is located immediately adjacent textile reinforcement 11. If, in the region of the greatest stressing of hose 1, namely in the region of the sideways folds, fissures develop through liner 12 and into textile reinforcement 11, then these fissures propagate under pressure loading and mechanical loading along the textile reinforcement, causing the fibers to separate from their rubber binder material. Such seal failure, which reaches the textile reinforcement, will, prior to a hose break, have already spread so far that the seal failure will have reached channel 14 via the textile reinforcement before the utility layer of liner 12 is used up. The present invention will provide timely warning also in such a case, and, for example, permit the pump to be shut off.

In the embodiment according to FIG. 3, the use of a hose with a channel provided in the liner is illustrated. Here, hose 20 is used as a transport hose, for example for emptying of tank cars and decanting of conveyed product into a storage container. In this case, in which the great mechanical loading of the hoses often found in hose pumps does not occur, many times no monitoring of the hose structure is carried out. Here, the present invention makes it feasible for the first time to connect channel 25 with the previously discussed detector means, so that even in the case of a transport hose, abrasion of the hose liner can be recognized before the textile reinforcement is reached and attacked.

Here, also, it is possible to use a hose according to FIG. 2, in which a warning signal is generated if the conveyed product travels along textile reinforcement 22 to channel 25, without liner 23 as such having reached its wear limit. Here, also, the warning signal can be given by pressure sensors, conductivity sensors or gas detectors. A gas detector on an infrared absorption basis can be used, for example during decanting of liquid propane or butane gas, specifically to detect in a detector circuit 26 the escape of hydrocarbons. However, as shown in FIG. 3, one can also install a pressure sensor 27 which indicates the application of conveying pressure in channel 25. There, for example, in an especially compact embodiment, the sensor lead 26 and detector 27 can be implemented as integral components of the hose coupling, so that it is unnecessary to attach, to the transport hose, any external components which in everyday use would be awkward and vulnerable to damage.

What is claimed is:

1. A method of safely transporting environmentally sensitive flowable materials through a hose (1, 20) having a cover (10, 21) and a liner (12, 23) and with at least one reinforcing layer (11, 22) located between the cover (10, 21) and at least one longitudinal safety channel (13, 14, 25) associated with the liner (12, 23), comprising the steps of repeatedly longitudinally constricting the hose without occluding the safety channel, and monitoring against intrusion of said flowable material into the safety channel.

2. A method according to claim 1, wherein said monitoring step comprises detecting a change in pressure within said safety channel.

3. A method according to claim 1 wherein said monitoring step comprises detecting a change in electrical conductivity within said safety channel.

4. A method according to claim 1, further comprising connecting said hose to a hose coupling, connecting said safety channel to a monitoring passage within said hose coupling, and monitoring conditions within said monitoring passage as an indication of intrusion of said flowable material into said channel.

5. A hose pump, comprising a pump housing (2, 6, 7) having an output union and an intake union;

at least one hose (1) connected to both the outlet union and the intake union and resting on an inner wall of said pump housing (2, 6, 7);

at least one squeezing member (3) which is so moved along the hose (1) that the hose (1) is constrictable by each squeezing member (3) from the direction of the intake union toward the direction of the outlet union, the hose having an inner liner (12), a cover (10) and a reinforcement (11) between the liner (12) and the cover (10);

the hose (1) having a through-passing channel (13, 14, 25) located in the liner (12), wherein the channel (13, 14, 25) is separated from an interior of the pump housing.

6. A hose pump according to claim 5, wherein, during operation, the channel (13, 14, 25) has, in a region of contact of the hose with the squeezing member, a continuous free cross-section.

7. A hose pump according to claim 5, wherein the channel (13, 14, 25) connects, adjacent at least one of the outlet union and the intake union, to a conduit (26) which is equipped with detection means (27) for the presence in the channel of conveyed product.

8. A hose pump according to claim 7, wherein said detection means is a pressure sensor.

9. A hose pump according to claim 7, wherein said detection means is a conductivity sensor.

10. A hose pump according to claim 7, wherein said detection means is an infra-red sensor.

11. A hose pump according to claim 7, wherein the channel (13, 14, 25) is filled with a fluid which triggers the detection means (27), without the conveyed product itself coming into contact with the detection means (27).

12. A hose pump according to claim 5, wherein the channel (14) is separated from the reinforcement (11) by a lesser wall thickness than from the inner hose surface (24).

13. A hose pump according to claim 5, wherein the channel (13, 25) is separated from the reinforcement (11, 22) by a greater wall thickness than from the inner hose surface (24).

14. A hose pump according to claim 5, wherein the hose is so located in the pump, that the channel (13, 14) is arranged in a region facing away from the squeezing member (3).

15. A hose pump according to claim 5, wherein a plurality of channels (13, 14, 25) are provided in the liner (12, 23).

* * * * *

UNITED STATES PATENT AND TRADEMARK OFFICE

CERTIFICATE OF CORRECTION

PATENT NO. : 6,093,002

DATED : July 25, 20000

INVENTOR(S) : Schneider

It is certified that error appears in the above-identified patent and that said Letters Patent is hereby corrected as shown below:

At column 2, line 66 "it" should be --if--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*